US009902041B2

(12) United States Patent
Kamei

(10) Patent No.: US 9,902,041 B2
(45) Date of Patent: Feb. 27, 2018

(54) ABRASIVE GRAIN JET GRINDING DEVICE

(71) Applicant: KAMEI TEKKOUSHO LTD., Higashiosaka-shi, Osaka (JP)

(72) Inventor: Haruo Kamei, Osaka (JP)

(73) Assignee: KAMEI TEKKOUSHO LTD., Osaka (JP)

( * ) Notice: Subject to any disclaimer, the term of this patent is extended or adjusted under 35 U.S.C. 154(b) by 78 days.

(21) Appl. No.: 14/773,777

(22) PCT Filed: Feb. 14, 2014

(86) PCT No.: PCT/JP2014/053437

§ 371 (c)(1),
(2) Date: Sep. 9, 2015

(87) PCT Pub. No.: WO2014/141810

PCT Pub. Date: Sep. 18, 2014

(65) Prior Publication Data

US 2016/0016288 A1 Jan. 21, 2016

(30) Foreign Application Priority Data

Mar. 15, 2013 (JP) ..... 2013-053417

(51) Int. Cl.
*B24C 5/06* (2006.01)
*B24C 1/08* (2006.01)
(Continued)

(52) U.S. Cl.
CPC ..... *B24C 5/06* (2013.01); *B24C 5/066* (2013.01); *B24C 1/08* (2013.01); *B24C 3/12* (2013.01); *B24C 3/14* (2013.01); *B24C 5/068* (2013.01)

(58) Field of Classification Search
CPC .... B24C 1/08; B24C 3/14; B24C 5/06; B24C 5/068; B24C 3/12; B24C 5/066
See application file for complete search history.

(56) References Cited

U.S. PATENT DOCUMENTS

RE20,538 E * 10/1937 Minich ..... B24C 5/068 451/91
2,118,832 A * 5/1938 Wean ..... B24C 3/14 451/80

(Continued)

FOREIGN PATENT DOCUMENTS

JP 62-223498 10/1987
JP 11-347945 12/1999

OTHER PUBLICATIONS

PCT, English translation of the International Preliminary Report on Patentability, PCT/JP2014/053,437 (dated Sep. 24, 2015).

(Continued)

*Primary Examiner* — Marc Carlson
(74) *Attorney, Agent, or Firm* — Thompson Hine LLP

(57) ABSTRACT

An abrasive grain jet grinding device having a belt partially wrapped around an impeller with blades between a shaft-side disc and an open disc and an open peripheral surface between the blades, a nozzle tangential to the disk at the point of separation between the belt and the peripheral surface, wherein the blades held between the shaft-side disc and the open disc are formed from thin plates to finely partition the circumference of the discs, are inclined forward in the direction of rotation of the discs, are provided densely so that multiple adjacent blades overlap each other, and are set with narrow gaps between the blades to form a large number of storage chambers for the abrasive grains.

3 Claims, 5 Drawing Sheets

(51) Int. Cl.
*B24C 3/12* (2006.01)
*B24C 3/14* (2006.01)

(56) References Cited

U.S. PATENT DOCUMENTS 2,286,754 A * 6/1942 Minich ..... B24C 5/068
451/95
2,364,077 A * 12/1944 Keefer ..... B24C 5/068
451/95
2,684,062 A 7/1954 Rose
2,779,455 A * 1/1957 Sinclair ..... B22D 29/006
198/564
6,146,247 A * 11/2000 Nokubi ..... B24C 5/06
451/38

OTHER PUBLICATIONS

PCT, International Search Report (dated Apr. 15, 2014, published Sep. 18, 2014).

* cited by examiner

[FIG. 1]
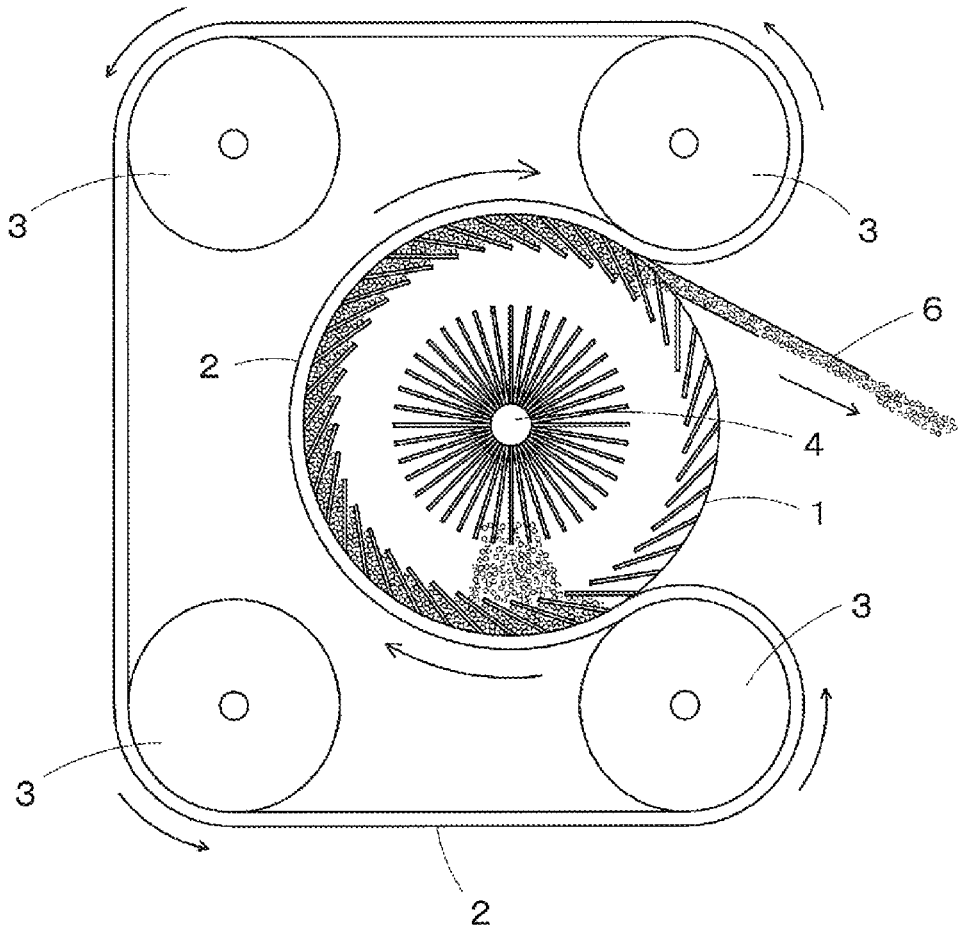

[FIG.2]
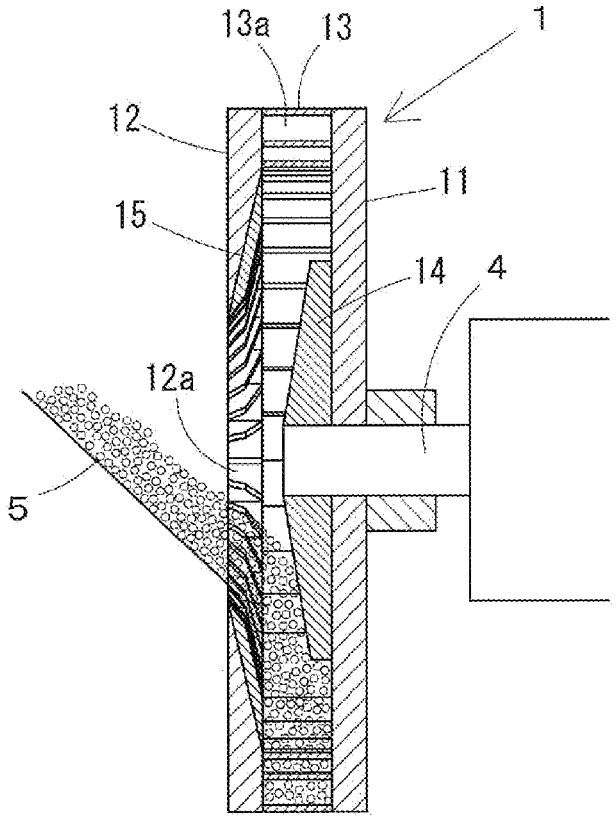

[FIG. 3]
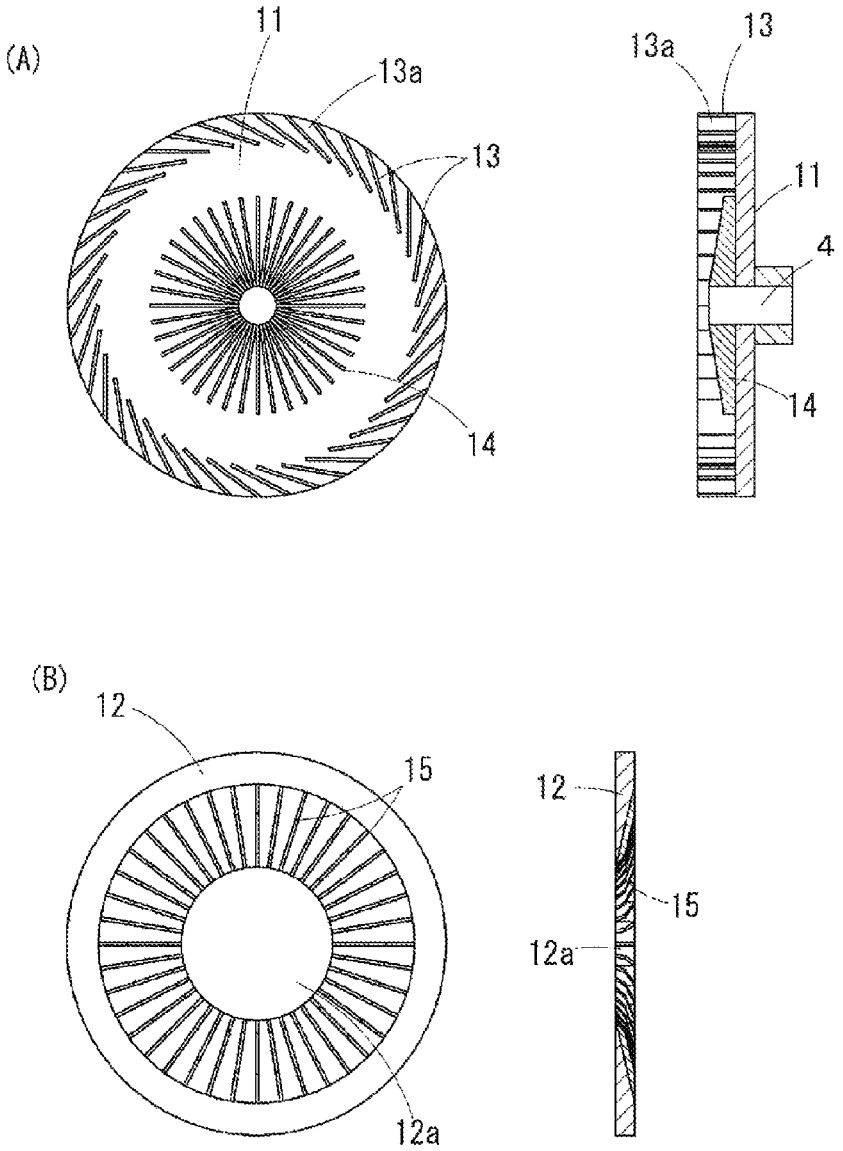

[FIG. 4]
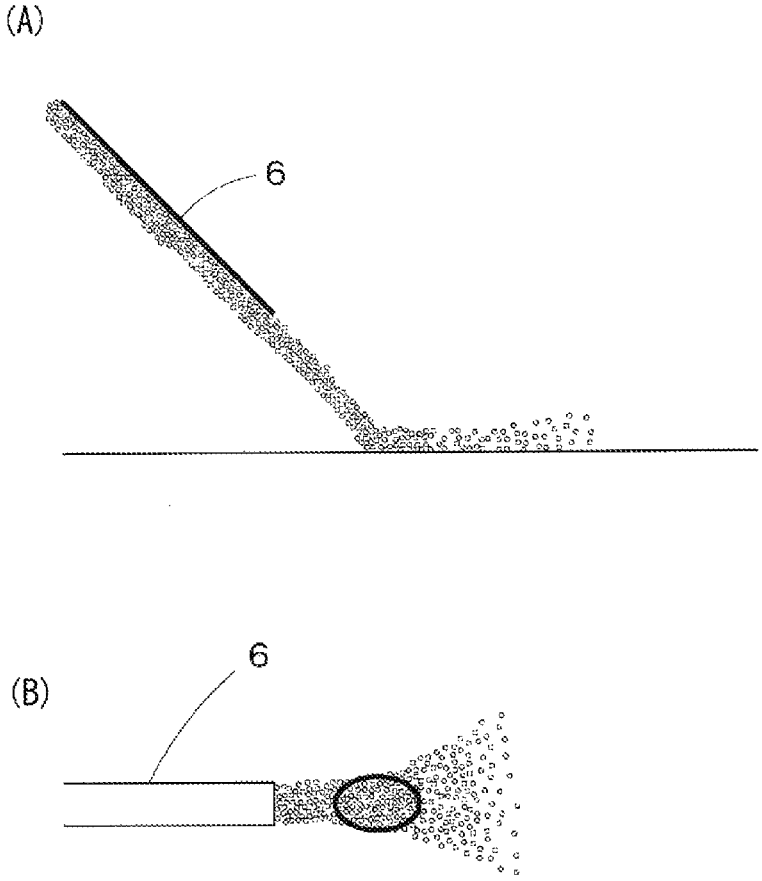

[FIG. 5]
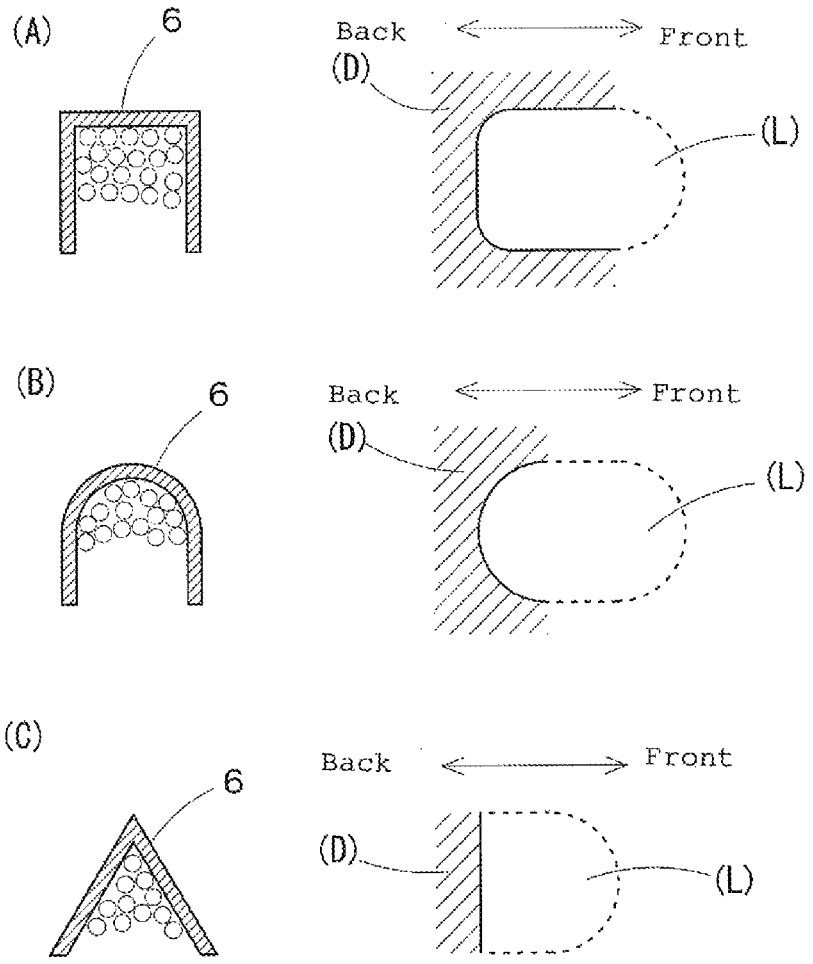

ABRASIVE GRAIN JET GRINDING DEVICE

TECHNICAL FIELD

The present invention relates to abrasive grain jet grinding devices that grind and polish the surface of a workpiece by spraying abrasive grains onto the workpiece, and more particularly relates to an abrasive grain jet grinding device that is useful in surface polishing of the workpiece.

BACKGROUND

In the final surface finishing of a product (workpiece), the surface of the workpiece needs to be finished to be fine and smooth. For example, a dental prosthesis has a complex irregular surface, and it is time consuming to polish the surface thereof. Japanese Unexamined Patent Application Publication No. 11-347945 discloses a device that surface-finishes a workpiece by spraying numerous abrasive grains in an oblique direction onto the surface of the workpiece. More specifically, sliding the abrasive grains on the surface of a workpiece achieves almost the same final finishing effect as polishing it with sandpaper. In such a case, a cluster of abrasive grains having a certain degree of density and some thickness is preferably impacted onto the workpiece surface in an oblique direction. To increase smoothness of the workpiece surface, the cluster of abrasive grains needs to be ejected continuously in a densely aggregated state at a predetermined grain density when the cluster is impacted onto the workpiece surface.

In known abrasive grain jet grinding devices, the abrasive grains ejected from an impeller are slightly scattered. For this reason, the abrasive grains need to be aggregated together again before being impacted onto the workpiece. The shape of current ejection nozzles does not adequately overcome this problem and meet the necessity to eject the abrasive grains continually in a densely aggregate state.

Since spacing between blades equally spaced on an impeller is relatively wide in the device disclosed in the aforementioned Publication No. 11-347945, the abrasive grains from the impeller are ejected not continuously but intermittently. In such a case, the abrasive grains impacting the workpiece are not densely aggregated, so that the abrasive grains are repelled and bounced in a direction instead of impacting in a direction of grinding and polishing the surface of workpiece. Consequently, such a device may not provide sufficient polishing. This is because in the case of a continuous cluster of mutually closely aggregated numerous abrasive grains, the abrasive grains interfere with each other when the cluster impacts onto the workpiece, and flow in a cluster on the workpiece. The degree of gloss of the polished surface of the workpiece becomes fine. If the abrasive grains are not densely aggregated, the abrasive grains, when impacted on the workpiece, are repelled and the direction of bounce is not stabilized. The polishing efficiency is low, and the polished surface is low in the quality of gloss.

SUMMARY

In view of the above problem, the disclosed abrasive jet grinding device has been developed. The disclosed device provides an impeller and a nozzle appropriate for polishing a workpiece surface by impacting the abrasive grains in the form of a continuously and densely aggregate cluster.

To solve the above problem, the disclosed device provides an abrasive grain jet grinding device having a grain jet ejector including an impeller that includes blades held between a shaft-side disk rotatable by a drive shaft and an open disk having an opening at a center thereof, and includes a circumferential surface having open slits between the blades, and a belt that is entrained between pulleys and the impeller such that part of the circumferential surface is closed to form a plurality of storage chambers for abrasive grains while the impeller is rotated, a feeder that feeds the abrasive grains into the impeller via the opening, and a nozzle that is arranged in a tangential direction of the disks at a point of separation between the belt and the circumferential surface of the impeller to spray the abrasive grains onto a workpiece. The blades held between the shaft-side disk and the open disk are thin plates to finely partition the circumferential surface of the impeller, are inclined obliquely forward in a direction of rotation of the disks, and are arranged densely with spacing between adjacent blades set to be sufficiently narrow to cause the adjacent blades overlap each other such that the storage chambers are formed for the abrasive grains.

In the above configuration, the number of storage chambers of the abrasive grains and the number of open slits around the circumferential surface of the impeller configured to eject the abrasive grains are much larger than those in the grinding device of related art. Since the number of times for ejecting the abrasive grains during one rotation of the impeller also increases, it looks like the abrasive grains are ejected continuously.

The abrasive grain jet grinding device further includes a large number of flow-straightening blades that are externally radially extended from the drive shaft of the shaft-side disk and are radially tapered with respect to the shaft-disk and a large number of flow-straightening blades that are radially extended on an inside ring surface of the open disk so as to face the first flow-straightening blades and are radially tapered with respect to the open disk.

The two types of flow-straightening blades accelerate the abrasive grains supplied from the feeder radially outwardly to the periphery of the impeller as the impeller rotates. The abrasive grains are guided into a large number of storage chambers formed by the disks and the abrasive grains stored are then ejected as a continuous cluster.

The nozzle has a triangular cross-sectional shape with a bottom opening.

Normally, a glossy portion is formed on the surface of the workpiece by ejecting abrasive grains from the nozzle, while a dull portion is formed surrounding the glossy portion. The use of the nozzle having a triangular cross-sectional shape polishes the workpiece surface more efficiently, resulting in the glossy portion.

The abrasive grain jet grinding device thus configured may include the blades held densely between the shaft-side disk and the open disk in a manner such that multiple adjacent blades mutually overlap each other with narrow spacing permitted therebetween and a large number of storage chambers of abrasive grains is formed. As a result, the abrasive grains are densely aggregated so that the abrasive grains are ejected through the nozzle as a continuous cluster of the abrasive grains. The abrasive grain jet grinding device thus provides a pronounced advantage of efficiently polishing the workpiece surface as a smooth and glossy surface.

The two types of flow-straightening blades accelerate the abrasive grains fed from the feeder radially outwardly, thereby efficiently guiding the abrasive grains into the large number of storage chambers formed by the blades and the belt. The continuous cluster of the abrasive grains thus results.

The nozzle having the triangular cross-sectional shape controls more the occurrence of the dull portion surrounding the glossy portion than a nozzle having a square or a semi-circular cross-sectional shape. The use of the nozzle having the triangular cross-sectional shape polishes the workpiece surface most efficiently.

BRIEF DESCRIPTION OF DRAWINGS

FIG. 1 generally illustrates an embodiment of the disclosed abrasive grain jet grinding device.

FIG. 2 is a cross-sectional view of an impeller of the embodiment of FIG. 1.

FIG. 3(A) shows a front view and a cross-sectional view illustrating the inside of a shaft-side disk; and FIG. 3(B) shows a front view and a cross-sectional view illustrating the inside of an open disk.

FIG. 4 illustrates the abrasive grain jet grinding device in an operational state.

FIG. 5 illustrates the shape of a nozzle, and a polished state of a workpiece.

DETAILED DESCRIPTION

An embodiment of the disclosed abrasive grain jet grinding device is shown in FIG. 1, which illustrates an impeller 1 that imparts a centrifugal force to abrasive grains, and an endless belt 2 that is wrapped around the impeller 1 such that the outer circumferential surface of the impeller 1 is partly covered with the belt 2. FIG. 1 also illustrates pulleys 3 that cause the belt 2 to rotate in synchronization with the impeller 1. FIG. 1 illustrates four pulleys 3 to drive the impeller 1, but the number of pulleys 3 is not limited to four. FIG. 1 also illustrates a drive shaft 4 configured to rotate the impeller 1. These elements form an abrasive grain ejector. The basic structure of the abrasive grain ejector remains unchanged from the basic structure of the abrasive grain ejector of related art.

The impeller 1 is described with reference to FIG. 2 and FIG. 3. In each of FIG. 2 and FIG. 3, the impeller 1 includes two disks having the same diameter, namely, a shaft-side disk 11 and an open disk 12, and a large number of blades 13 held between the shaft-side disk 11 and the open disk 12. The impeller 1 has open slits on the outer circumferential surface with one between two adjacent blades. The blades 13 are thin plates such that the outer circumferential surface of each disk is finely segmented, and is inclined obliquely forward in the direction of rotation and densely arranged such that multiple adjacent blades 13 overlap mutually with spacing between the adjacent blades 13 set to be narrow. As a result, a large number of storage chambers 13*a* are formed by the belt in contact with the outer circumferential surface of the impeller 1 and the belt. In this configuration, the number of storage chambers 13*a* and the number of open slits on the outer circumferential surface of the impeller 1 through which the abrasive grains are ejected are much larger than those in prior art impellers. The number of times the abrasive grains are ejected per single rotation is large enough to look like the abrasive grains are continuously ejected.

A large number of first flow-straightening blades 14 that are radially tapered from a drive shaft 4 toward the external circumference are arranged around the drive shaft 4 on the shaft-side disk 11. The open disk 12 has at the center thereof an opening 12*a* that receives the abrasive grains fed by a feeder 5. The open disk 12 includes on the ring-shaped internal side thereof a large number of second flow-straightening blades 15 facing the first flow-straightening blades 14 and radially tapered with respect to the donut-shaped internal side. The use of the two types of first flow-straightening blades 14 and second flow-straightening blades 15 radially outwardly moves and accelerates the abrasive grains fed from the feeder 5 as the impeller 1 rotates. The abrasive grains are thus guided to a large number of storage chambers 13*a* formed by the blades 13 and the stored abrasive grains are then discharged as a continuous cluster of abrasive grains.

The large number of blades 13 arranged on the periphery of the impeller 1 mutually cooperates with the first and second flow-straightening blades 14 and 15 that move and accelerate the abrasive grains, thereby densely aggregating the abrasive grains and ejecting the abrasive grains as a continuous cluster of the abrasive grains.

Since a flow of densely clustered abrasive grains ejected from the impeller 1 flies in a slightly scattered fashion, the flow needs to be re-clustered before being impacted on the workpiece. For this reason, a nozzle 6 having a passage narrowed in the direction of movement of the abrasive grains is slightly tilted downward. If the nozzle 6 has a fully closed wall on four sides, the nozzle 6 may be possibly blocked with the abrasive grains. The nozzle 6 is thus opened with the lower side wall thereof partly removed. The polished portion of the workpiece is different depending on the cross-sectional shape of the nozzle 6.

FIG. 5 illustrates how the polished shape differs depending on the cross-sectional shape of the nozzle when the abrasive grain cluster ejected from the nozzle is impacted on the workpiece as illustrated in FIG. 4. Since the abrasive grain cluster ejected from the nozzle is densely continuous, an impact portion is polished and becomes glossy as a glossy portion (L). The degree of gloss in the surrounding area is slightly decreased. A dull portion (D) thus results. This is because when the abrasive grain cluster impacts on the workpiece, the abrasive grains collide with each other, and some abrasive grains deviate from a target area. The number of deviated abrasive grains is relatively smaller and a portion where the deviated abrasive grains have polished appears as a dull portion. The appearance of the dull portion is different depending on the shape and the location of the nozzle.

The nozzle having a square cross-sectional shape as illustrated in FIG. 5(A) generates a generally rectangular glossy portion (L). The central glossy portion (L) is surrounded by a dull portion (D) on both sides of the glossy portion (L) and a back side of the glossy portion (L) in the direction of advance of the abrasive grains. If the nozzle has a semi-circular cross-section as illustrated in FIG. 5(B), an oval glossy portion (L) appears, and a dull portion (D) appears behind the glossy portion (L) surrounding a rear circular edge of the glossy portion (L). If the nozzle has a triangular cross-section as illustrated in FIG. 5(C), a glossy portion (L) having a generally triangular shape with a rounded end appears, and a dull portion (D) appears behind the glossy portion (L) along the rear edge thereof.

When a wide flat area of the workpiece is polished in the actual operation, the workpiece is moved up and down and rightward and leftward. With the nozzle having the square cross-sectional shape, the dull portion (D) remains with the workpiece moved backward, and the central area becomes a glossy portion (L) while right and left side areas remain the dull portion (D). If the workpiece is moved forward, the rear dull portion is polished, becoming a glossy portion (L), but the right and left side dull portions (D) remain. If the workpiece is moved rightward and leftward, the dull portion becomes a glossy portion (L) but a dull portion (D) remains.

With the nozzle having a semi-circular cross-sectional shape, the right and left dull portions (D) are small in area, and the results are alleviated.

If the nozzle having the triangular cross-sectional shape is used, the dull portion (D) appears behind the back edge of the rounded triangular glossy portion (L). If the workpiece is moved rightward and leftward, only the dull portion (D) remains. For this reason, if the workpiece is moved forward while shifting rightward and leftward, the entire polishing surface is free from any dull portion.

As discussed above, the polishing results on the surface becomes different depending on the shape of the nozzle. It is found that if the polishing surface is relatively wide, a nozzle having a triangular cross-sectional shape most efficiently polishes the workpiece to form the glossy portion. In the present invention, the nozzle having the triangular cross-sectional shape is employed.

As discussed above, in the abrasive grain jet grinding device constructed as discussed above of the embodiment of the present invention, the large number of blades 13 arranged on the periphery of the impeller 1 cooperates with the first and second flow-straightening blades 14 and 15 that accelerate to feed the abrasive grains into the blades 13. The abrasive grains are thus densely aggregated and ejected in a continuous cluster of abrasive grains. A high-quality glossy surface thus results. The use of the nozzle having the triangular cross-sectional shape causes the abrasive grain cluster to be ejected onto the workpiece efficiently. The efficiency of the polishing operation is increased in the surface polishing.

REFERENCE SIGNS LIST

1 Impeller
2 Belt
3 Pulleys
4 Drive shaft
5 Feeder
6 Nozzle
11 Shaft-side disk
12 Open disk
12*a* Opening
13 Blades
13*a* Storage chambers
14 First flow-straightening blades
15 Second flow-straightening blades

What is claimed is:

1. An abrasive grain jet grinding device comprising:

a grain jet ejector including an impeller having blades held between a shaft-side disk rotatable by a drive shaft and an open disk having an opening at a center thereof, a circumferential surface having open slits between the blades, and a belt that is entrained between pulleys and the impeller such that part of the circumferential surface is closed so that a plurality of storage chambers for abrasive grains is formed while the impeller is rotated;

a feeder that feeds the abrasive grains into the impeller via the opening;

a nozzle that is arranged in a tangential direction of the disks at a point of separation between the belt and the circumferential surface of the impeller to spray the abrasive grains onto a workpiece, wherein the blades held between the shaft-side disk and the open disk are thin plates to finely partition the circumferential surface of the impeller, are inclined obliquely forward in a direction of rotation of the disks, and are arranged densely with spacing between adjacent blades set to be narrow to cause the adjacent blades overlap each other in a manner such that the storage chambers are formed for the abrasive grains;

a first plurality of flow-straightening blades on the shaft-side disk that are externally radially extended from the drive shaft and are radially tapered; and a second plurality of flow-straightening blades that are radially extended on an inside ring surface of the open disk so as to face the first plurality of flow-straightening blades and are radially tapered with respect to the open disk.

2. The abrasive grain jet grinding device according to claim 1, wherein the first plurality of flow-straightening blades are radially tapered outwardly with respect to the shaft-disk; and the second plurality of flow-straightening blades are radially tapered inwardly with respect to the open disk.

3. The abrasive grain jet grinding device according to claim 1, wherein the nozzle has a cross-sectional shape with a bottom opening, the cross-sectional shape selected from a triangular shape, a square shape, and a semi-circular shape.

* * * * *